US005879269A

United States Patent [19]

Reck

[11] Patent Number: 5,879,269

[45] Date of Patent: Mar. 9, 1999

[54] TRAINING DEVICE FOR THE PHYSICALLY DISABLED

[75] Inventor: Martin Reck, Betzenweiler, Germany

[73] Assignee: Anton Reck, Betzenweiler, Germany

[21] Appl. No.: 40,474

[22] Filed: Mar. 18, 1998

[30] Foreign Application Priority Data

Mar. 18, 1997 [DE] Germany ..... 197 11 176.9

[51] Int. Cl.[6] ..... A63B 24/00

[52] U.S. Cl. ..... 482/6; 482/57; 482/904; 601/32; 601/36

[58] Field of Search ..... 482/1–9, 51, 57–60, 482/62–66, 900, 901, 904; 601/23, 24, 26, 27, 32–36; 280/304.1

[56] References Cited

U.S. PATENT DOCUMENTS

| | | | |
|---|---|---|---|
| 4,351,406 | 9/1982 | Lay | 482/57 |
| 4,824,132 | 4/1989 | Moore | 482/60 |
| 4,941,652 | 7/1990 | Nagano et al. . | |
| 5,256,115 | 10/1993 | Scholder et al. . | |
| 5,284,131 | 2/1994 | Gray | 482/57 |

FOREIGN PATENT DOCUMENTS

| | | |
|---|---|---|
| 4118082 | 3/1993 | Germany . |
| 4415256 | 11/1995 | Germany . |
| 19529764 | 2/1997 | Germany . |

*Primary Examiner*—Glenn E. Richman

*Attorney, Agent, or Firm*—Venable; George H. Spencer; Catherine M. Voorhees

[57] ABSTRACT

A training device is proposed having a crank for a training device for the physically disabled includes a crank, an electric motor which is connected to the crank, power electronics which are designed at least for driving the motor, and means for regulating and/or controlling the rotation speed at the crank. The training device for the physically disabled, makes it possible to use their residual movement capabilities and residual muscle power, in order to ensure a training sequence that is as effective as possible. The means for regulating and/or controlling the rotation speed are designed for a rotation speed change $\Delta n$ as a function of the torque $M_K$ on the crank $\Delta n=f(M_K)$, a new rotation speed $n_{new}$ being obtained from the old rotation speed $n_{old}$ in accordance with the relationship $n_{new}=n_{old}+\Delta n$, and the function $\Delta n=f(M_K)$ being different for specific value ranges of $M_K$ defined in advance. In a further embodiment, the means for regulating and/or controlling the rotation speed are designed for a rotation speed change $\Delta n$ in such a manner that, if an energy input $E_K$ has already been supplied by the trainee applying a torque $M_K$ to the crank and this has led to a rotation speed increase, a rotation speed increase $\Delta n$ remains if, immediately after the energy input, an amount of energy is taken from the mechanical system which is present in the training device or is modeled electronically, which amount of energy corresponds to a value which results from the energy input $E_K$ minus the energy loss resulting from the braking torque $M_B$ and/or friction torques $M_R$.

12 Claims, 1 Drawing Sheet

TRAINING DEVICE FOR THE PHYSICALLY DISABLED

BACKGROUND OF THE INVENTION

The invention relates to a training device having a crank for the physically disabled.

PRIOR ART

Many versions of training devices having a crank have become known and normally have a mechanical design with a large inertia mass. The inertia mass has the object of ensuring a uniform rotational movement of the crank. However, the physical size and physical shape of the training device are governed in a disadvantageous manner by this inertia mass. In contrast, in the case of a number of versions, a braking torque is preset electronically. The braking torque represents a torque which counteracts the crank.

U.S. Pat. No. 5,256,115 discloses a movement trainer in which the flywheel is likewise simulated by electronic means, these electronic means have the characteristics of a flywheel which is physically actually present. This means that a rotation speed change $\Delta n$ can be described by the following function over the entire value range of a torque $M_{pedal}$ on the pedals: $\Delta n=(M_{pedal}-M_B)*A/J$, where $M_B$ is an adjustable braking torque, A is a constant and J is an inertia moment. Irrespective of whether it is positive or negative, a rotation speed change $\Delta n$ is thus proportional to the torque on the pedal over the entire value range of the torque, since, although the other variables are adjustable, the rotation speed change and torque remain unchanged over a large number of revolutions. This movement trainer is designed as a training device for those involved in competitive sports, and thus for people who have unimpeded movement capability. The pedals are not driven by the movement trainer.

In the ease of injuries or illnesses with low residual forces, including disabilities on one side (for example as a consequence of a stroke), the difficulty arises, however, of producing any movement at all, where possible even a circular movement. Such patients can generally exert muscle power only over part of a revolution. Active/passive trainers have therefore been developed which have the capability of continuing a rotational movement, even if the patient is no longer able to apply a torque to a crank.

However, these devices have the disadvantage that a trainee with little residual muscle power cannot substantially influence the rotational movement by pedaling.

SUMMARY OF THE INVENTION

The invention is based on the object of providing a training device for the physically disabled, by means of which it is possible to react to remaining movement capabilities and residual muscle power in order to ensure a training sequence that is as effective as possible.

This object is achieved by a training device having a crank for the physically disabled including pedals on arms of the crank for connection to the feet or arms of the person being trained, an electronic motor connected to the crank, power electronics designed for driving the motor and means for regulating and/or controlling the rotation speed of the crank wherein the regulating and/or controlling means determines a rotation speed change $\Delta n$ as a function of a torque $M_K$ on the crank in accordance with $\Delta n=f(M_K)$, and obtain a new rotation speed $n_{new}$ for an old rotation speed $n_{old}$ in accordance with the relationship $n_{new}=n_{old}+\Delta n$ where the function $\Delta n=f(M_K)$ is different for specific predetermined value ranges of $M_K$. Further advantageous and expedient developments of the training device according to the invention will become apparent from the following description.

The invention is based on a training device having a crank for the physically disabled, pedals or the like being provided on the crank arms, for connection to the feet or arms of the person being trained. The training device further includes an electric motor which is connected to the crank, power electronics which are designed at least for driving the motor, and means for regulating and/or controlling the rotation speed n of the crank. The essence of a first solution according to the invention is now that the means for regulating and/or controlling the rotation speed are designed for a rotation speed change $\Delta n$ as a function of a torque $M_K$ on the crank in accordance with $\Delta n=f(M_K)$. In this case, a new rotation speed $n_{new}$ is produced from the old rotation speed $n_{old}$ in accordance with the relationship $n_{new}=n_{old}+\Delta n$, the function an $\Delta n=f(M_K)$ being different, as an essential feature of the invention, for specific value ranges of $M_K$ defined in advance. These measures allow, in particular, different magnitudes of a rotation speed change to be achieved for the acceleration and for the deceleration of the crank so that, for example, even a minimal torque applied by the patient is sufficient to cause a major rotation speed increase, by choosing the function $\Delta n=f(M_K)$ in a specific range of the torque $M_K$. At the same time, excessively large torque components transmitted in the form of impulses from the patient to the crank can be "masked out" so that a sharp rotation speed increase is permissible only in a specific value range of the crank torque $M_K$.

In the case of a second solution according to the invention, the essence of the idea is that the means for regulating and/or controlling the rotation speed are designed for a rotation speed change $\Delta n$ in such a manner that, if an energy input $E_K$ has already been supplied by the trainee applying a torque $M_K$ to the crank and this has led to a rotation speed increase, a rotation speed increase $\Delta n$ remains if, immediately after the energy input, an amount of energy is taken from the mechanical system which is present in the training device or is modeled electronically, which amount of energy corresponds in terms of magnitude to a value which results from the energy input $E_K$ minus the energy loss resulting from the braking torque $M_B$ and/or friction torques $M_R$. In contrast to the first solution for a rotation speed change $\Delta n$, this measure results in a law being provided which is not necessarily a function of the torque $M_K$ on the crank. The main effect of this measure is that the brief rotation speed increase caused by a torque $M_k$ applied by the trainee decays again only slowly. In the case of conventional training devices, the relationship between the energy and the rotation speed described above is incorporated differently. If, in such a system, that element of the energy is subtracted which results from the difference between the energy supplied to the system by the person working it and the braking and/or friction energy absorbed by the system, the crank once again rotates at the same speed as before the energy input by the person working the device (providing any freewheeling mechanism which does not also drive the crank in the direction of operation is not considered).

For both solutions, changes to the rotation speed may take place even for small angle ranges within a crank revolution, depending on the resolution of the rotation speed regulation. For example, in the case of discrete signal processing, the resolution is governed by the sampling time T for detection of the torque or of a parameter proportional to the torque, in which case the sampling time T may be considerably shorter than the period duration of one crank revolution. In the case of such sampling, the function for the rotation speed change $\Delta n$ may be written, for example, in the form $\Delta n=n(t_i)-n(t_{i-1})=F(M_K,t_{i-1})$, $(t_i)-(t_{i-1})$ corresponding to the time between two samples, that is to say the operating time T.

In order to provide a simple criterion for the acceleration and deceleration of the crank, one advantageous embodiment proposes that a braking torque $M_B$ be defined which may also have the value "zero", such that, if the value of the torque on the crank is $M_K>M_B$, the means for regulating and/or controlling the rotation speed n are designed for a rotation speed increase, and if $M_K<M_B$, they are designed for a reduction in the rotation speed, the magnitudes of the rotation speed changes $\Delta n$ according to the invention being different for $M_K>M_B$ and for $M_K<M_B$.

In the case of an embodiment of the invention which is furthermore particularly advantageous, the magnitude of the rotation speed change $\Delta n$ produced by the means for regulating and/or controlling the rotation speed is greater for $M_K>M_B$ than for $M_K<M_B$. This measure produces a sort of "residual muscle power gain". This means that, if the patient exceeds a previously defined braking torque, he can produce a sharp increase in rotation speed, which drops only slowly when the torque is less than the braking torque. Apart from the fact that it allows a continuous training sequence to be possible for the first time, the advantage of this procedure is that it also has a positive psychological effect, to an extent that should not be underestimated, even for tiny residual muscle power levels. This is because the patient realizes, possibly for the first time, that he has any residual muscle power at all and, furthermore, is thus able to produce a circular pedaling movement.

For one simple implementation option of the invention, it is also proposed that the function of the rotation speed change an follows the following rule:

$$\Delta n \sim (M_K-M_B)/k,$$

"~" representing proportionality and k being a factor which assumes at least a value $k=k_i$ for $M_K-M_B>0$ and assumes at least a value of $k=k_j$ for $M_K-M_B<0$ where $k_i<k_j$, so that the rotation speed increases more sharply for $M_K-M_B>0$ than the amount by which it drops for $M_K-M_B<0$. A microprocessor, for example, can be programmed appropriately for such regulation, in a particularly simple manner.

One particularly advantageous development of the invention comprises the capability to set a basic rotation speed via the means for regulating and/or controlling the rotation speed. This measure allows a patient to be taken through the motions passively without himself needing to apply any torque to the crank. However, as soon as he overcomes, for example, a preset braking torque $M_B$, he can further increase the rotation speed.

If a preset basic rotation speed is used, it is also advantageous if the means for regulating and/or controlling the rotation speed switch off the preset basic rotation speed when a previously set limit torque $M_{K,limit}$ occurs on the crank and the crank is driven by the vector. This avoids injuries which may occur if the preset basic rotation speed were to force rotation, for example in the event of the trainee having cramp. In this context, it is furthermore advantageous if, when the preset basic rotation speed is switched off, the means for regulating and/or controlling the rotation speed are designed such that the crank oscillates slowly, and the basic rotation speed is resumed. The process in which the crank oscillates or carries out a rocking movement may start with a small angular deflection, which is increased until the rocking movement changes back to a rotational movement. An embodiment is likewise advantageous in which the means for regulating and/or controlling the rotation speed are designed for starting in the direction opposite to the previous rotation direction. This corresponds to the antagonistic principle for overcoming cramp.

It is furthermore advantageous if the crank rotation direction can be preset, for example for a basic rotation speed, via the means for regulating and/or controlling the rotation speed. Different crank rotation directions allow different muscle areas in the patient to be trained.

BRIEF DESCRIPTION OF THE DRAWING

A exemplary embodiment of the invention is described in the following text, and is explained in more detail in the following description, quoting further advantages and details.

The FIGURE shows the block diagram of a preferred circuit for controlling or regulating a training device according to the invention.

DESCRIPTION OF THE EXEMPLARY EMBODIMENT

Figure 1:
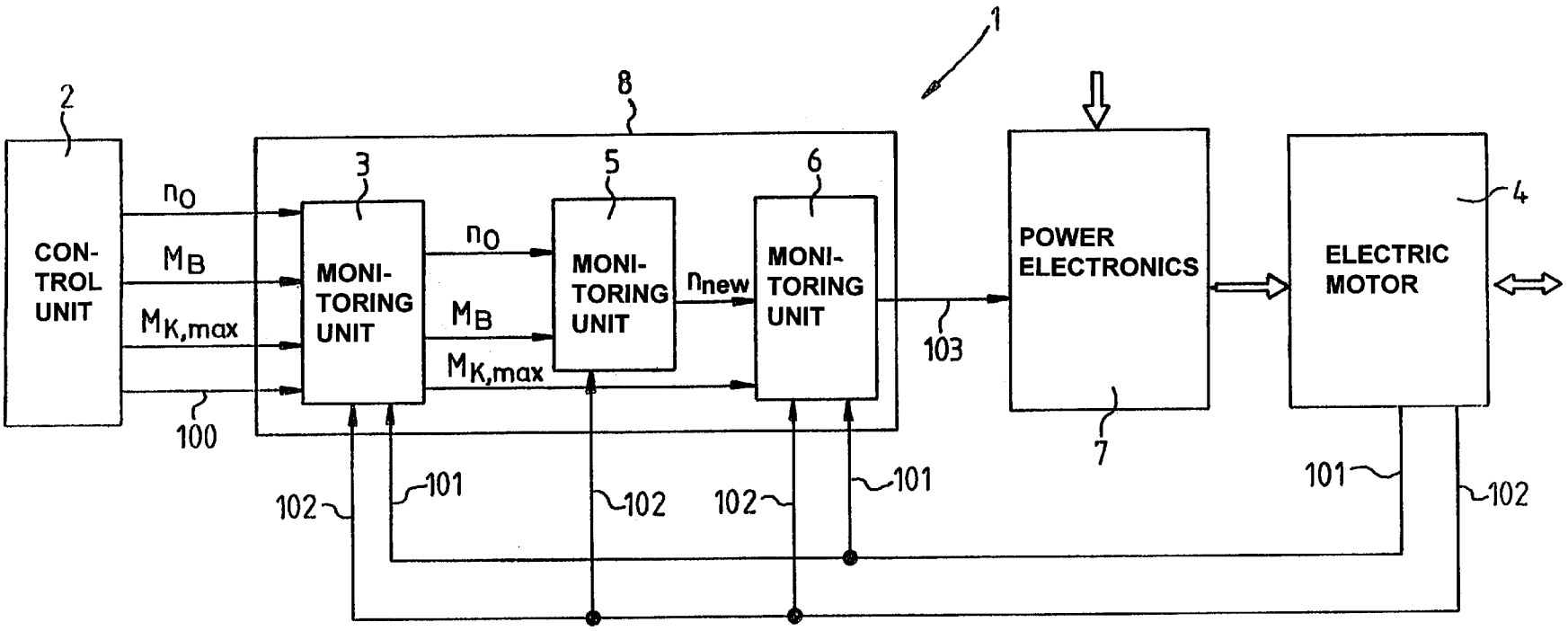

The FIGURE is intended to illustrate the operation of a training device according to the invention, with reference to a schematically illustrated block diagram of a circuit 1 for control and/or regulation. In the circuit 1, the information flow is represented by single, solid arrows while, in contrast, the energy flow is intended to be symbolized by arrows drawn bold. The circuit according to the invention comprises a control unit 2 via which a basic rotation speed $n_0$, a braking torque $M_B$, a maximum permissible torque on the crank $M_{K,max}$ and various other parameters can be entered. These values are passed on to a general monitoring unit 3, according to the arrows marked in the circuit 1 by $n_0$, $M_B$, $M_{K,max}$ and 100. For information and adaptation purposes, the general monitoring unit 3 is also supplied with a signal 101, which corresponds to the actual rotation speed of the crank (not shown) which is connected to an electric motor 4 and is used to accommodate the trainee's feet. Furthermore, likewise for information and, possibly, adaptation purposes, the general monitoring unit 3 receives a signal 102, which corresponds to the actual torque $M_K$ on the crank. The torque signal 102 is then supplied to a monitoring unit 5 for the rotation speed change $\Delta n$, and to a monitoring unit 6 for the rotation speed and the torque on the crank. The rotation speed signal 101 is supplied not only to the general monitoring unit 3, but also to the monitoring unit 6 for the rotation speed on the torque.

One major element of the circuit 1 is formed by the monitoring unit 5 for the rotation speed change $\Delta n$. For example, a rotation speed change $\Delta n$ results from the relationship $\Delta n=(M_K-M_B)*A/k$. In this relationship, $M_K$ is the torque on the crank, $M_B$ is the braking torque, A is a factor and k is a value that depends on the value of the difference $M_K-M_B$. A value $k=k_i$ is set for $M_K-M_B>0$ and a value $k=k_j$ is set for $M_K-M_B<0$, where $k_i<k_j$. This means that, if the braking torque $M_B$ which the monitoring unit 5 receives from the monitoring unit 3 is exceeded at the crank, a rotation speed increase $\Delta n_i$ occurs, whose magnitude is greater than the rotation speed reduction $\Delta n_j$ when the resultant torque $M_K-M_B$ is negative again. In other words, the magnitude of $\Delta n$ is greater for $M_K-M_B>0$ than for $M_K-M_B<0$. The rotation speed change $\Delta n$ is added in the monitoring unit 3 to an old nominal rotation speed $n_{old}$, and thus produces the new nominal rotation speed $n_{new}$.

If a preset basic rotation speed is active, the basic rotation speed $n_0$ entered from the control unit 2 is used as the basis for this calculation. This means that, for a first rotation speed change $\Delta n$, the new nominal rotation speed $n_{new}$ is obtained from the sum of $n_0$ and $\Delta n$. This value is then used as the old nominal rotation speed for the next calculation of the new nominal rotation speed. In the situation in which the result is a negative rotation speed change $\Delta n$, the preset basic rotation speed means that the rotation speed does not fall below the value $n_0$, however.

The respective instantaneous nominal rotation speed $n_{new}$ is passed on to the monitoring unit 6 for the rotation speed and the torque, and this monitoring unit 6 processes the rotation speed signal 101 so that a manipulated variable 103 is passed on to the power electronics 7 and then flows in an appropriate manner through the electric motor 4 connected to the crank, in order to achieve the nominal rotation speed.

When a basic rotation speed $n_0$ has been preset, in order to avoid injuries to a trainee whose feet are, for example, connected to the pedals of the crank, a maximum crank torque $M_{K,max}$ may be set on the control unit 2, and this is passed via the monitoring unit 3 to the monitoring unit 6. If the torque signal 102 exceeds this maximum permissible torque, the preset basic rotation speed is switched off, and the crank comes to rest. The monitoring unit then starts the acceleration from rest. An appropriate prior setting allows the rotation direction to be changed in this case. This is worthwhile if, for example, the torque limit is used for people with spastic disabilities when cramp occurs. Starting the crank in the opposite direction corresponds to the antagonistic principle for overcoming cramp.

In the present exemplary embodiment, the monitoring units 3, 5, 6 are implemented in a microcontroller 8, which carries out digital signal processing. To this end, the rotation speed signal 101 and the torque signal 102 are sampled at a sampling frequency of $f=1/T$, and are supplied to the microcontroller 8. A rotation speed change $\Delta n$ and a new nominal rotation speed $n_{new}$ are expediently calculated from this after each sampling interval T. Subject to the precondition that the sampling time T is very much shorter than the period duration of the rotational movement at the crank, the rotation speed changes are carried out during small angular rotations of the crank. This results in a highly dynamic relationship between a torque $M_K$ at the crank and a rotation speed change resulting from this.

The procedure according to the invention provides a training device for physically disabled people, which training device can be used even with very little residual muscle power to ensure a continuous training sequence governed largely by the disabled person himself or herself. If the patient has only very little residual muscle power, the braking torque $M_B$ can be reduced to such an extent that the value $M_K-M_B$ becomes positive even for a very low torque level at the crank, but produces a large rotation speed change by means of a correspondingly low value for k. As soon as the patient is no longer able to apply any torque to the crank, the rotation speed does not decay with this low value of k. This is because, when $M_K-M_B<0$, a large value can be set for k, according to the invention, so that, if required, the rotation speed drops only slightly before the next power pulse from the patient as a result of which the value $M_K-M_B$ becomes positive again. This results in fantastic psychological motivation for disabled people who become aware, possibly for the first time, that they still have some residual muscle power.

I claim:

1. A training device for the physically disabled having a crank with pedals for connection to the feet or arms of a disabled person being trained, said training device comprising:

an electric motor connected to the crank for assisting the disabled person in driving the crank;

power electronics connected to said electric motor and converting a received, generated signal for at least driving said motor at a rotation speed; and means for regulating the rotation speed of the crank and outputting the generated signal to said power electronics wherein said regulating means determines a rotation speed change $\Delta n$ as a function of a torque $M_K$ applied by the disabled person on the crank in accordance with $\Delta n=f(M_K)$, obtains a new rotation speed $n_{new}$ from a previous rotation speed $n_{old}$ in accordance with $n_{new}=n_{old}+\Delta n$ and generates an output signal based on the determined rotation speed change and the newly obtained rotation speed, the function of $\Delta n$ being different for specific, predetermined value ranges of the crank torque.

2. A training device for the physically disabled having a crank with pedals for connection to the feet or arms of a disabled person being trained, said training device comprising:

an electric motor connected to the crank for assisting the disabled person in driving the crank;

power electronics connected to said electric motor and converting a received, generated signal for at least driving said motor at a rotation speed; and means for regulating the rotation speed of the crank and outputting the generated signal to said power electronics wherein said regulating means determines a rotation speed change and generates a signal corresponding to the determined rotation speed change $\Delta n$ so that if the disabled person supplies an energy input and applies a torque $M_K$ on the crank which increases the rotation speed of the crank, a rotation speed change $\Delta n$ remains if, immediately after the energy input, an amount of energy corresponding to the energy input minus energy loss resulting from a braking torque $M_B$ is taken from a mechanical system of said training device or is modeled electronically.

3. The training device according to claim 2 wherein the amount of energy taken from the mechanical system or modeled electronically corresponds to the energy input minus energy loss resulting from the braking torque $M_B$ and friction torques $M_R$.

4. The training device according to claim 2 wherein the amount of energy taken from the mechanical system or modeled electronically corresponds to the energy input minus energy loss resulting from friction torques $M_R$.

5. The training device according to claim 1, wherein said regulating means increases the rotation speed if the value of the torque on the crank is $M_K>M_B$ where $M_B$ is a braking torque and reduces the rotation speed if $M_K<M_B$, the magnitudes of the rotation speed changes $\Delta n$ being different for $M_K>M_B$ and for $M_K<M_B$.

6. The training device according to claim 5, wherein said regulating means calculates a greater rotation speed change $\Delta n$ when $M_K>M_B$ than if $M_K<M_B$.

7. The training device according to claim 6 wherein said regulating means further determines the rotation speed change $\Delta n$ in accordance with $\Delta n \sim (M_K-M_B)/k$ where $\sim$ represents proportionality and k is a factor which assumes at least a value of $k=k_i$ for $M_K-M_B>0$ and at least a value of $k=k_j$ for $M_K-M_B<0$, and $k_i<k_j$ so that the rotation speed increases more sharply for $M_K-M_B>0$ than the amount by which the rotation speed drops for $M_K-M_B<0$.

8. The training device according to claim 1, wherein said regulating means presets a basic rotation speed.

9. The training device according to claim 8, said regulating means switches off the preset basic rotation speed when an adjustable limit torque is applied to the crank and the crank is driven by said electric motor.

10. The training device according to claim 9, said regulating means causes the crank to oscillate slowly when the basic rotation speed is switched off, and then the basic rotation speed is resumed.

11. The training device according to claim 9, wherein said regulating means causes the rotation of the crank to start in a direction opposite to the previous rotation direction.

12. The training device according to claim 1, wherein said regulating means can preset the rotation direction of the crank.

* * * * *